US006264586B1

(12) United States Patent
Webber

(10) Patent No.: US 6,264,586 B1
(45) Date of Patent: Jul. 24, 2001

(54) FOLDABLE EXERCISE BENCH

(76) Inventor: Randall T. Webber, 100 Harbor Dr., #1404, San Diego, CA (US) 92101

( * ) Notice: Subject to any disclaimer, the term of this patent is extended or adjusted under 35 U.S.C. 154(b) by 0 days.

(21) Appl. No.: 09/366,511

(22) Filed: Aug. 3, 1999

(51) Int. Cl.[7] ..... A63B 21/078
(52) U.S. Cl. ..... 482/104; 482/142
(58) Field of Search ..... 482/104, 130, 482/133, 142; D21/690, 695; 297/354.1, 354.11, 354.12, 354.13, 377; 5/532, 133, 142, 313.1

(56) References Cited

U.S. PATENT DOCUMENTS

| | | | | |
|---|---|---|---|---|
| D. 314,026 | | 1/1991 | Jennings . | |
| D. 327,719 | | 7/1992 | Towley, III et al. . | |
| D. 369,840 | | 5/1996 | Clem . | |
| D. 384,116 | | 9/1997 | Brefka . | |
| D. 390,287 | | 2/1998 | Hsieh . | |
| D. 390,895 | | 2/1998 | Brefka . | |
| 4,234,979 | * | 11/1980 | Bergerud | 5/133 |
| 4,369,966 | | 1/1983 | Silberman et al. . | |
| 4,624,457 | | 11/1986 | Silberman et al. . | |
| 4,634,127 | | 1/1987 | Rockwell . | |
| 4,754,508 | * | 7/1988 | Nishiguchi | 5/90 |
| 4,826,157 | | 5/1989 | Fitzpatrick . | |
| 4,861,025 | | 8/1989 | Rockwell . | |
| 4,936,572 | * | 6/1990 | Desiderio | 482/142 |
| 4,974,839 | | 12/1990 | Cantor . | |
| 5,056,779 | | 10/1991 | Webb . | |
| 5,106,081 | | 4/1992 | Webb . | |
| 5,322,489 | | 6/1994 | Webb et al. . | |
| 5,402,544 | * | 4/1995 | Crawford et al. | 297/354.13 |
| 5,437,589 | | 8/1995 | Habing . | |
| 5,727,764 | | 3/1998 | Angeles . | |
| 5,833,590 | * | 11/1998 | Chiu et al. | 482/142 |
| 5,882,283 | | 3/1999 | Stevens . | |
| 5,921,897 | | 7/1999 | Stevens . | |

FOREIGN PATENT DOCUMENTS

| | | | | |
|---|---|---|---|---|
| 2236685 | * | 4/1991 | (GB) | 482/104 |

OTHER PUBLICATIONS

Parabody 866 Strength Building System brochure, 1995.
Treadmills Everyoung EY86800F Jog & Fold brochure, ©1997 Men's Journal Company, L.P.
Tuff Stuff Brochure, TWC–35 Wide Combo Bench and TID–45 Multi–Purpose Bench, copy revd by Pto Mar. 1998.
Tuff Stuff TWC–35 Assembly Instructions, Oct. 1997.
Vectra, On–Line 1800 Brochure, ©1994 7 pages.*

* cited by examiner

*Primary Examiner*—John Mulcahy
(74) *Attorney, Agent, or Firm*—Brown, Martin, Haller & McClain, LLP

(57) ABSTRACT

A foldable exercise bench is pivotally mounted on a stationary frame; for movement between a retracted, generally upright storage position and at least one deployed position for supporting a person during exercise. A support foot located adjacent one end of the bench is pivotally mounted for rotation between a first, storage position extending generally alongside the bench when the bench is in the upright, storage position, and a second, support position in which the support foot extends forwardly at an angle to the bench and engages the floor to support the bench in the deployed position. A pivotal linkage between the support foot and frame automatically pivots the support foot from the second position to the first, storage position when the bench is moved into the upright, storage position.

25 Claims, 7 Drawing Sheets

FOLDABLE EXERCISE BENCH

BACKGROUND OF THE INVENTION

The present invention relates generally to exercise benches used for support when performing weightlifting or other resistance-type exercises, and is particularly concerned with a foldable exercise bench which can be folded up for storage.

Exercise equipment typically requires a large amount of floor space, regardless of whether it is in use or not. Thus, the advantages of a folding design for exercise benches and the like have been recognized for some time. Most prior art foldable exercise benches have disadvantages in that they require removal of lock pins before folding up for storage, and replacement of pins to lock the bench in the stored position. Such locking pins can fall out, be misplaced, or, if used improperly, may result in serious injury. One example of a foldable bench which must be locked in position via one or more locking pins is U.S. Pat. No. 5,882,283 of Stevens. In this case, a base member is pivotally connected to the frame and the two part bench is pivotally mounted on the base member. A stand is pivotally connected to the base member. A retractable device allows the bench and base member to be raised and lowered, and must be pinned in an extended position when the bench is moved into the raised, storage position.

Other folding benches are described in U.S. Pat. Nos. 4,634,127 and 4,861,025 of Rockwell, 4,826,157 of Fitzpatrick, and 4,369,966 of Silberman. In each case, the bench is movable into a vertical storage position, but one or more locking pins or devices must be removed in order to allow the bench to be pivoted into the storage position, and the bench must be locked in the storage position.

SUMMARY OF THE INVENTION

It is an object of the present invention to provide a new and improved foldable exercise bench.

According to the present invention, a foldable exercise bench is provided which comprises a stationary frame, an exercise bench pivotally mounted on the frame for movement between a retracted, generally upright storage position and at least one deployed position for supporting a person during exercise, the bench having opposite first and second ends, a support foot adjacent the first end of the bench pivotally mounted relative to the bench for rotation between a first, storage position extending generally alongside the bench when the bench is in the upright, storage position, and a second, support position in which the support foot extends at an angle to the bench and engages the floor to support the bench in the deployed position, and a pivotal linkage between the support foot and frame for automatically pivoting the support foot from the second position to the first, storage position when the bench is moved into the upright, storage position, the bench and support foot each being freely movable from the deployed and first positions to the storage and second positions, respectively, by lifting the bench.

Preferably, the pivotal linkage comprises a four-bar linkage having a first bar pivoted at one end to the frame and at the other end to the upper end of the support foot, and a second bar pivoted to the frame at a location spaced from the first bar, and pivoted to the support foot at a location spaced from the upper end. The bench is preferably supported on top of the first bar. In a preferred embodiment, the bench is formed in two separate parts, comprising a back rest and a seat, and at least the back rest is pivotally mounted on the first, support bar for movement between a plurality of different orientations relative to the seat. Both the back rest and seat may be mounted on a carriage slidably mounted on the first bar for bench adjustment purposes. Alternatively, the bench may be formed in one part with one user supporting pad.

The four-bar linkage is designed such that the bench is self-locking in both the exercise ready and storage position. The four-bar linkage thus acts to automatically lock the support foot in a safe and secure position in both the storage position and the exercise-ready or deployed position of the bench. This avoids the need for any secondary locking device which must be unlocked prior to moving the bench and then re-locked when the bench reaches its new position. Instead, the user can fold or unfold the bench quickly and easily using only one hand.

Preferably, the bench rotates through an angle of greater than 90° when moving between the deployed position and the storage position. In other words, the bench is folded past 90° (or perpendicular to the ground) in the storage position. This provides for optimum weight distribution, allowing the bench to stay in the generally upright, storage position without the use of a locking pin. Once in the storage position, the bench cannot easily be tipped over.

The support foot preferably has an attachment device for selective mounting of an accessory such as a leg exercise device or arm exercise device, or a support for the user when performing different exercises. Due to the stable storage position, any attached accessory does not have to be removed prior to storing the bench. Preferably, the attachment device comprises an attachment tube secured to the foot at a predetermined orientation such that it extends substantially vertically when the bench is in the storage position. The support foot is arranged to project forwardly at an angle to the vertical when engaging the floor in the first position, for added stability and self-locking.

Preferably, the support frame includes at least one upright member having a front side and a rear side, the bench extending forwardly from the front side of the upright member, and at least one horizontal, ground engaging member secured to the lower end of the upright member and extending a predetermined distance rearwardly from the upright member.

This provides a stable base for resisting tipping of the bench when the first end is folded upwardly and rearwardly through an angle of greater than 90°.

According to a preferred embodiment of the invention, the bench is formed in two parts, comprising a backrest and a seat, and the backrest is pivotable relative to the seat into a plurality of different possible orientations depending on the exercise to be performed, including a flat orientation aligned with the seat for performing flat press exercises, a first inclined orientation relative to the seat for performing incline press exercises, and a second inclined position at nearly 90° to the seat for performing shoulder press exercises. In one embodiment, the support frame comprises two spaced upright members with a cross bar extending between the members to which the bench is attached via the pivot linkage. A second cross bar is adjustably mounted at any one of a series of at least three different heights on the upright members corresponding to the different backrest positions, and the backrest lies against the second cross bar in each of the different positions to provide the desired backrest angle.

According to another aspect of the present invention, an adjustable bench apparatus is provided which comprises a support frame, a support bar projecting in a generally forwards direction from the support frame, a bench adjustably mounted on the support bar, the bench having a seat and a back rest pivotally movable relative to the seat between a plurality of different orientations, and a carriage slidably mounted on the support bar for movement into any one of a plurality of different positions on the support bar, at least the back rest being secured to the carriage, whereby movement of the carriage along the bar rotates the back rest relative to the seat. In one embodiment of the invention, the support frame comprises a pair of spaced upright members and a cross bar extending between the upright members, and the back rest is supported against the cross bar. The seat and back rest are both mounted on the carriage, whereby movement of the carriage towards and away from the cross bar will cause the back rest to rotate upwardly and downwardly about the pivot. Preferably, a support wheel is rotatably mounted at the center of the cross bar, the wheel having a groove, and the back rest has a pivot support which engages the groove.

This helps to reduce wear as the back rest is adjusted, and reduces side-to-side wobble in the back pad or back rest during use.

Preferably, the cross bar is adjustably mounted on the upright members for positioning at a plurality of different heights. The height of the cross bar will determine the basic height and angle of the back pad, while movement of the bench pad carriage will provide further angle adjustment.

This arrangement may be provided in conjunction with either a folding or a non-folding bench.

The folding bench of this invention is much easier to move back and forth between storage and exercise-ready positions, requiring only one hand and no lock pins in any position. The improved back rest adjustment also has many advantages in reduced wear, better stability, and easier seat position adjustment.

BRIEF DESCRIPTION OF THE DRAWINGS

The present invention will be better understood from the following detailed description of some preferred embodiments of the invention, taken in conjunction with the accompanying drawings in which like reference numerals refer to like parts and in which.

DESCRIPTION OF THE PREFERRED EMBODIMENTS

FIGS. 1 to 12 illustrate an exercise bench apparatus 10 for performing free weight exercises according to a first embodiment of the present invention. The apparatus 10 basically comprises an upright frame 12 and a bench 14 adjustably secured to the frame via pivot linkage 16. The bench is freely movable between the deployed position of FIGS. 1 to 3 and the generally upright, storage position of FIG. 6 without requiring removal of any lock pins or the like, as explained in more detail below.

Figure 1:
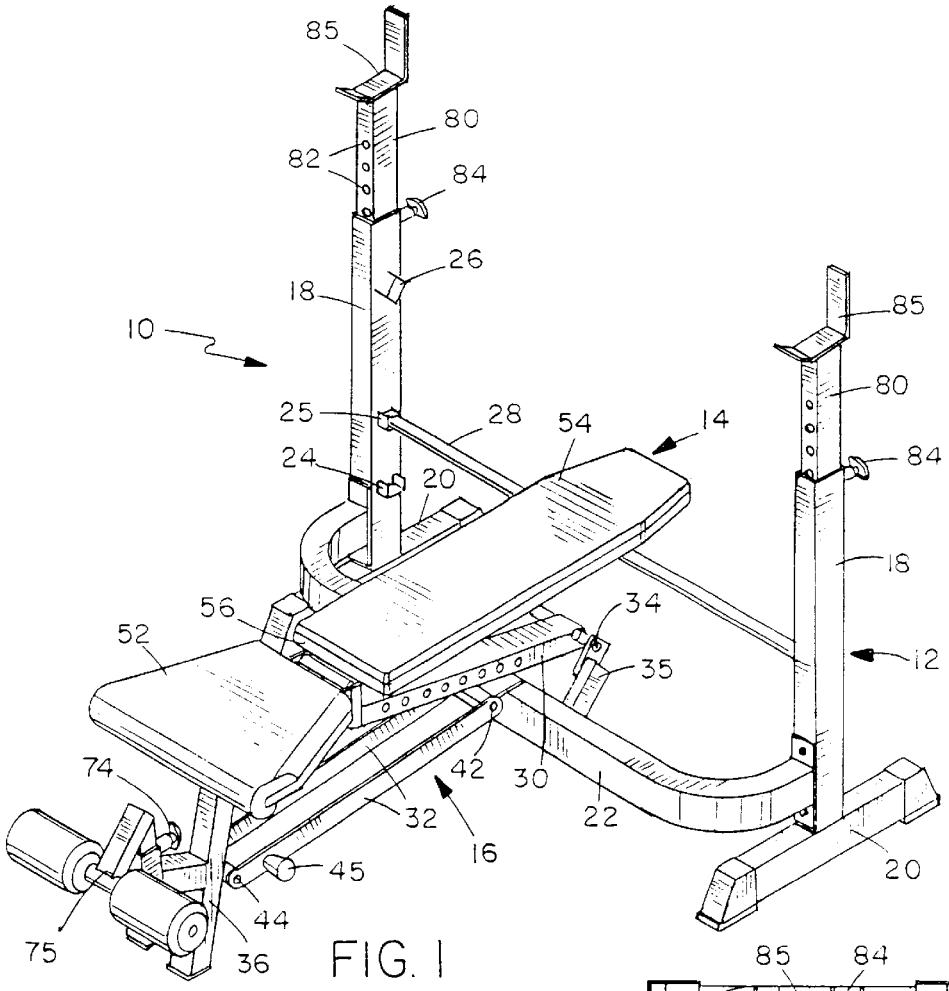
FIG. 1 is a perspective view of the foldable exercise bench according to a first embodiment of the invention.
Figure 6:
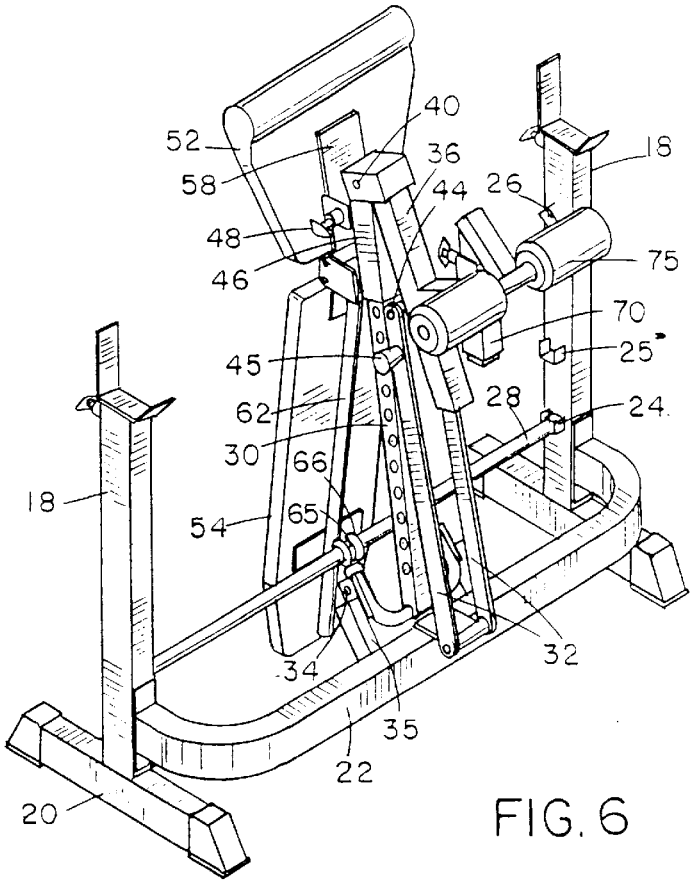
FIG. 6 is a perspective view showing the structure folded for storage.
Figure 7:
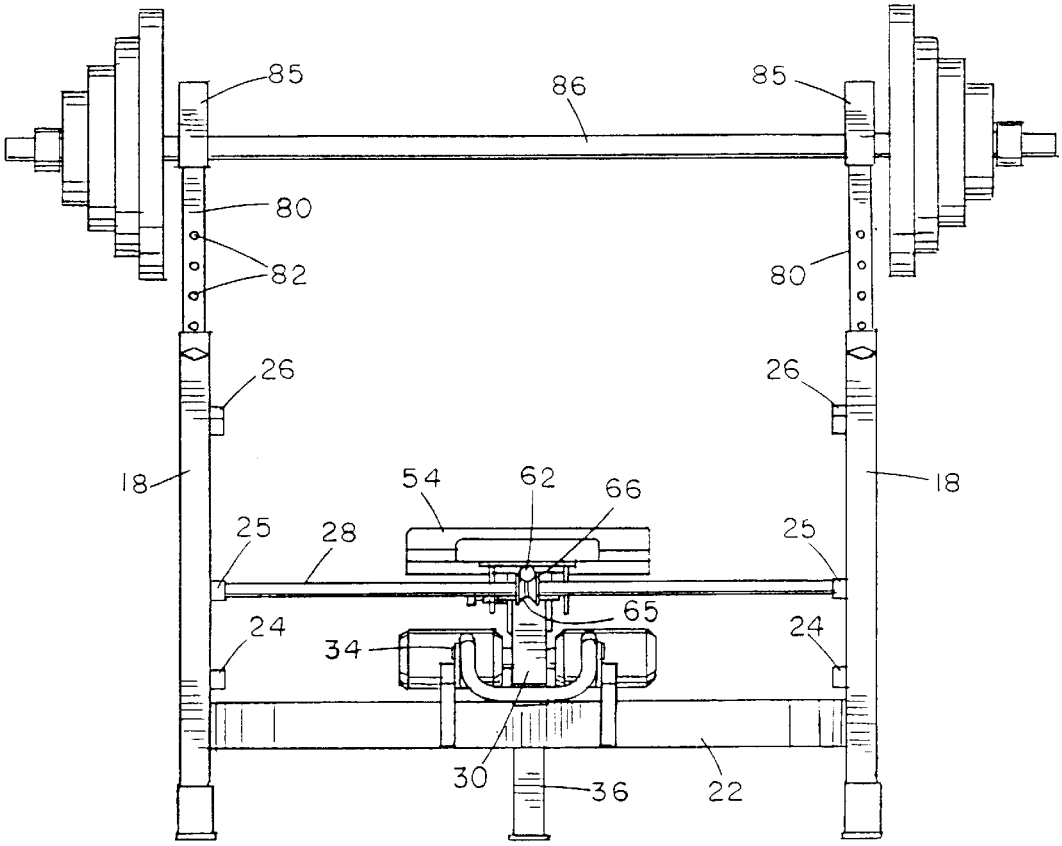
FIG. 7 is a rear view of the unit in the position of FIG. 3, and showing barbells on the vertical supports.
Figure 8:
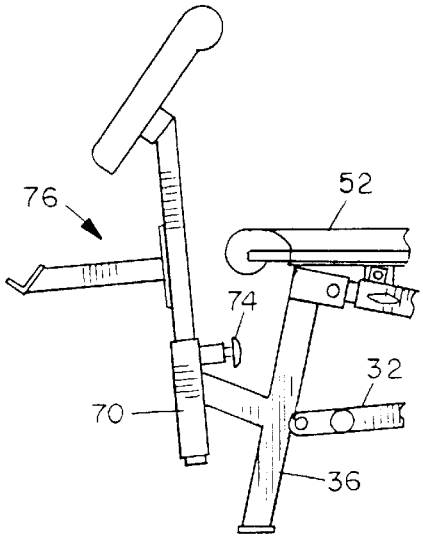
FIG. 8 is a partial side view showing an optional accessory attached to the support foot.

The upright frame 12 basically comprises a pair of spaced, upright struts 18 each having a cross bar or transverse base strut 20 at its lower end for stability, and a frame cross member 22 extending between the struts 18 at a location adjacent their lower ends, with arcuate end portions such that member 22 is offset forwardly from the plane defined by struts 20. A series of spaced pairs of aligned, U-shaped brackets 24,25,26, respectively, are provided on the opposing inner faces of upright struts 18, as best illustrated in FIGS. 1, 6 and 7. An adjustable cross member or rod 28 is selectively seated on any of the pairs of brackets so as to extend between the brackets. A greater number of brackets or indents may be provided along the length of each strut 18 to provide greater adjustability in the height of rod 28, if desired.

The pivot linkage 16 is a four bar linkage, comprising a primary link or support bar 30 and a secondary link 32. Primary link or bar 30 has one end pivotally mounted on the frame via pivot pin 34 mounted between a pair of rigid flanges 35 extending from cross member 22 at a rearwardly inclined angle. A support foot 36 for the bench 14 is pivotally mounted at the forward end of primary link or support bar 30 via pivot 40. Secondary link 32 is pivotally secured to cross member 22 at its rear end via pivot pin 42 spaced below and forwardly from pivot pin 34. The forward end of link 32 is pivotally secured to support foot 36 via pivot pin 44 spaced below pivot pin 40. Secondary link 32 is provided with oppositely directed handles 45 at a location adjacent its forward end pivot 44. Secondary link 32 comprises a pair of parallel connecting links or bars, as best illustrated in FIGS. 1 and 6.

Figure 2:
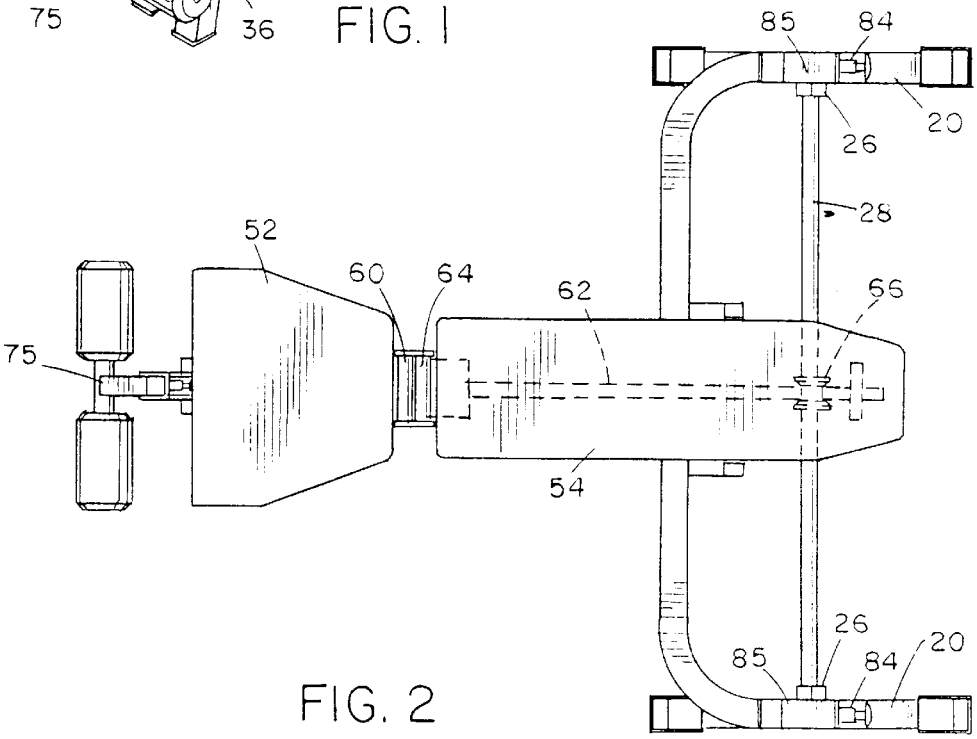
FIG. 2 is a top plan view of the unit.

The bench 14 is supported on primary link or support bar 30 via sliding carriage 46 which is slidably mounted on bar 30 and securable in any one of a plurality of selected positions along bar 30 via pop pin 48 engageable in any one of the openings 50 in bar 30. Bench 14 is formed in two separate parts, comprising a seat pad 52 and a back pad 54 having adjacent inner ends 55,56, respectively. Seat pad 52 is mounted on a base plate 58 which is pivotally mounted on carriage 46 via pivot pin 60 at location adjacent the inner end 55 of the seat pad. Similarly, back pad 54 is mounted on a support rod 62 which is also pivotally mounted on carriage 46 via pivot pin 64 adjacent the inner end 56 of the back pad. Thus, the seat pad and back pad are separately pivoted on the carriage 46 and can rotate independently from one another. Support rod 62 is designed to rest in a concave groove 65 on a support wheel 66 rotatably mounted at a central position on the adjustable cross bar 28, as best illustrated in FIGS. 2 and 7. The wheel 66 is rotatably mounted between collars on the shaft or cross bar 28 to retain it in its central position. Thus, as the carriage slides backwards or forwards along primary link tube 30, the back support rod 62 runs along groove 65, rotating wheel 66 and allowing smooth movement of the back pad 54. As an alternative to this arrangement, the sliding interengagement between wheel 66 and back pad 54 may be provided by a linear, concave groove running along the back of pad 54, in which the convex rim of wheel 66 slidably engages.

Figure 3:
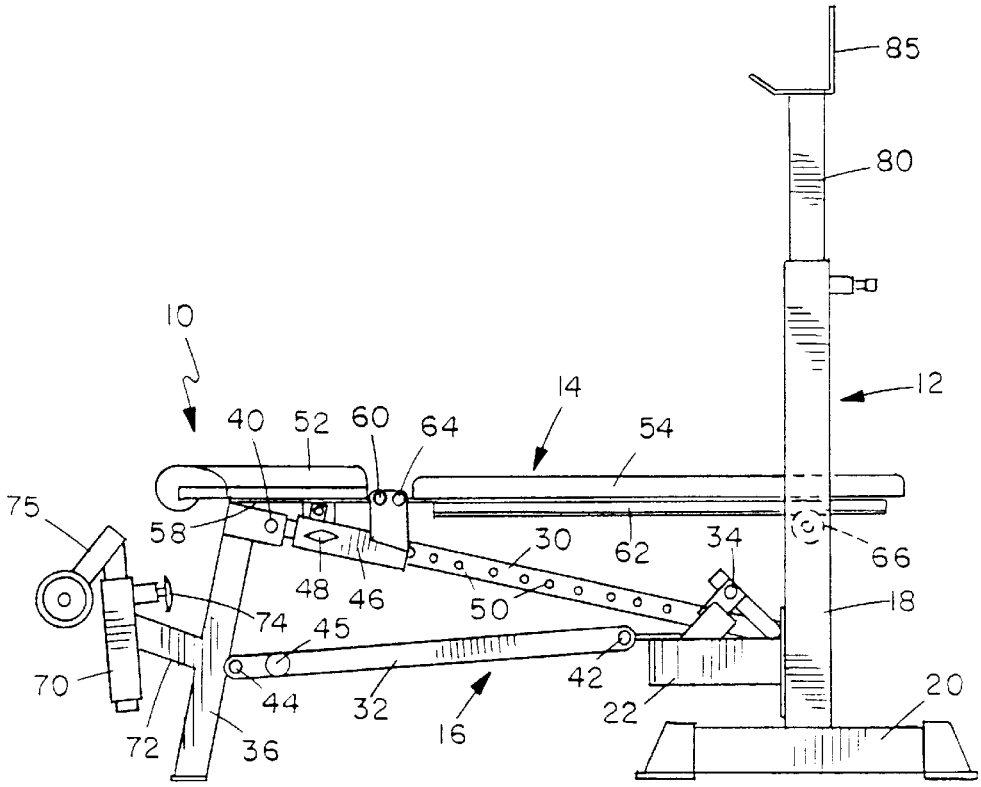
FIG. 3 is a side view with the bench in a horizontal position.
Figure 4:
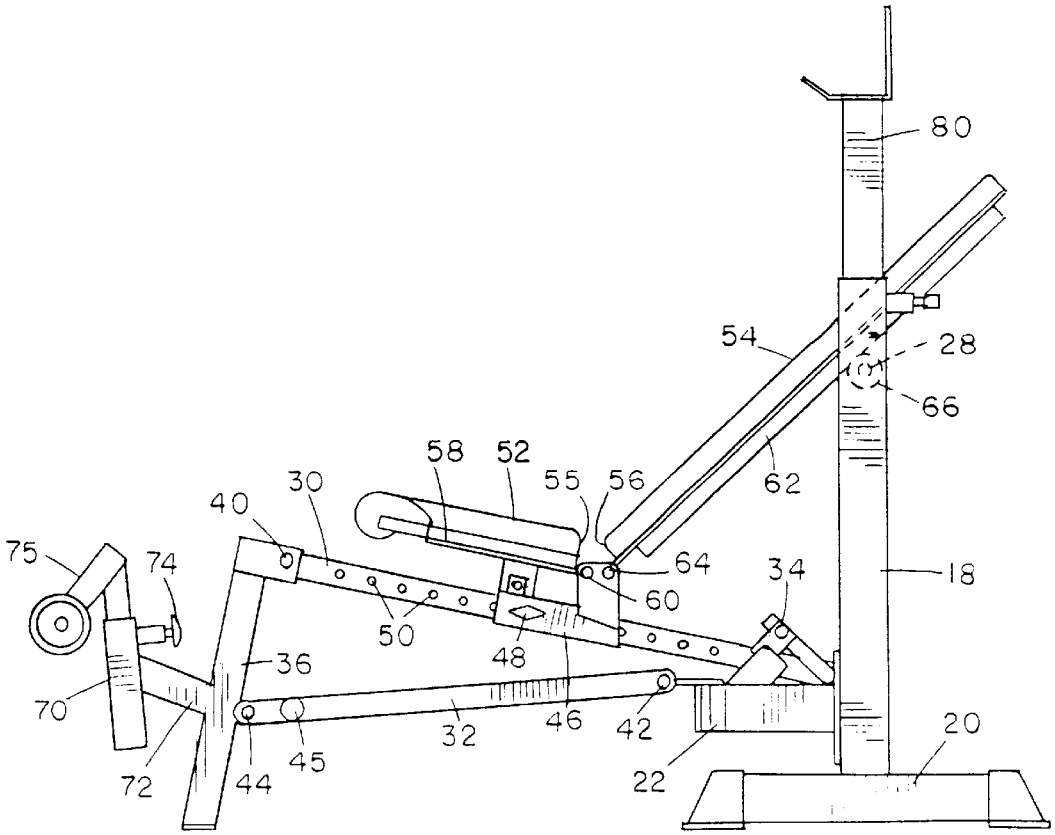
FIG. 4 is a side view with the back rest raised to an intermediate position.
Figure 5:
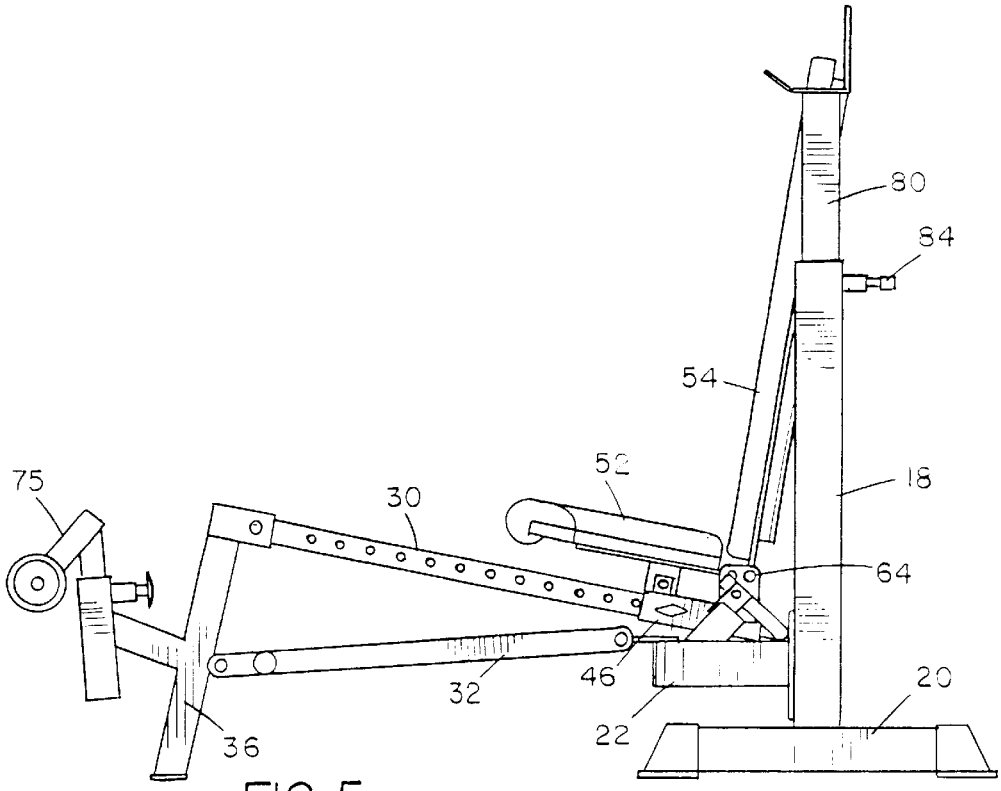
FIG. 5 is a side view with the back rest fully raised.
Figure 9:
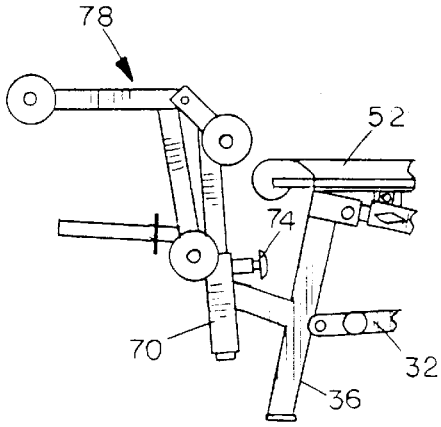
FIG. 9 is a partial side view showing a different accessory attached to the support foot.

As best illustrated in FIGS. 3 to 5, an accessory attachment tube 70 is secured to support foot 36 via connecting bar 72 which projects outwardly from the front face of foot 36. The arrangement is such that, when the support foot is in its extended, operative position engaging the ground to support the front end of the bench 14, it will be inclined forwardly from pivot 40 at a non-normal angle to the ground surface. The attachment tube 70 is oriented at an angle relative to the support foot 36 so that the tube 70 extends vertically when the foot is in the operative, ground engaging position of FIGS. 1 and 3 to 5. Attachment tube 70 may be used to attach any desired accessory to the foot, via a releasable pop pin 74 on the tube which engages an opening in a mating telescopic member on the accessory. Thus, for example, adjustable leg rollers 75 may be attached to tube 70 as illustrated in FIGS. 1 to 6. Alternatively, a preacher curl attachment 76 may be inserted in tube 70, as in FIG. 8. FIG. 9 illustrates another option in which a leg extension/curl attachment 78 is attached to tube 70. Other accessories may also be attached to tube 70, as desired.

Each of the uprights 18 is a tubular member with an open upper end, and an upper strut 80 is telescopically mounted in the open upper end of each of the uprights 18. Each of the struts 80 has a series of spaced openings 82 (see FIG. 1), and a releasable pop pin 84 extends through an opening adjacent the upper end of each upright 18 to releasably engage a selected one of the openings 82 to secure the strut 80 at a selected height. Each strut 80 has a bracket 85 at its upper end. A barbell 86 may be placed across brackets 85 when not in use, as illustrated in FIG. 7, and used in performing press exercises by individuals lying on bench 14 in the flat press position of FIGS. 1 to 3, for example.

Figure 10:
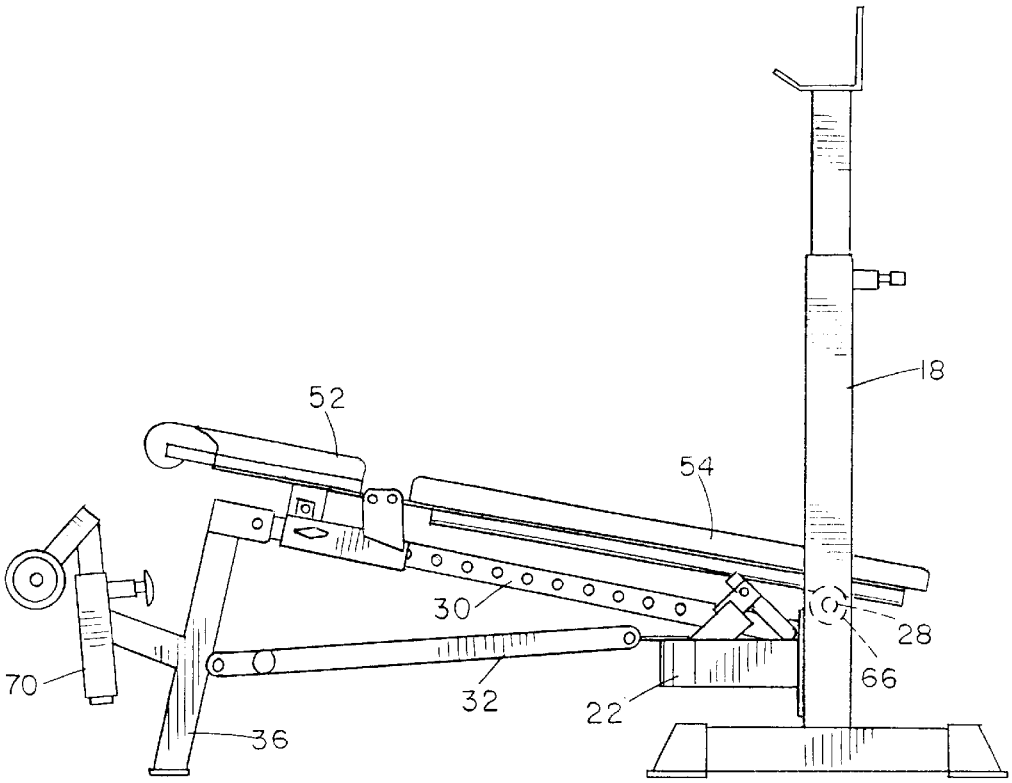
FIG. 10 is a side view with the bench in a declined position.
Figure 11:
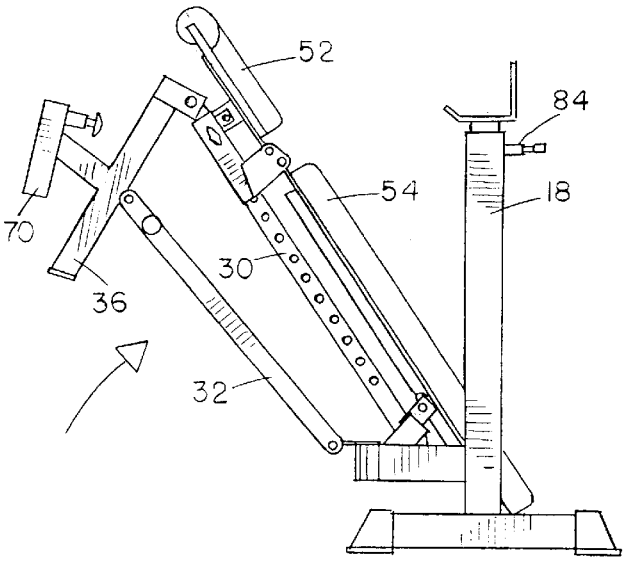
FIG. 11 is a side view showing the bench partially folded.
Figure 12:
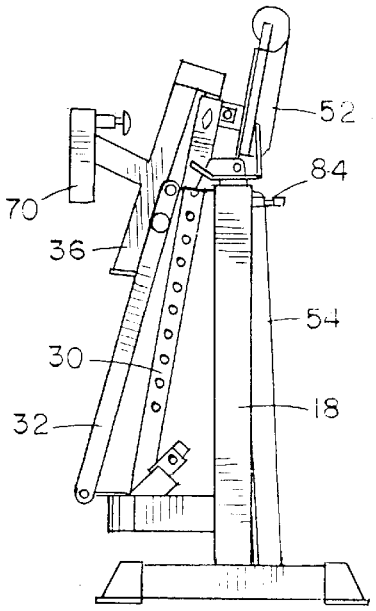
FIG. 12 is a side view showing the bench fully folded.

The folding exercise bench of FIGS. 1 to 12 requires no secondary adjustment to change from an exercise ready position as illustrated in FIGS. 1 to 3 and 10 and a storage position as illustrated in FIGS. 6 and 12. The relationship between the pivoting support foot 36 and the secondary connecting links 32 is such that the secondary links 32 wedge the support foot against the primary link tube 30 in a stable and secure position when deployed in the exercise ready position of FIGS. 1 to 3. When the bench 14 is to be moved into a storage position so that it takes up less floor space when not in use, the bench is simply lifted up at its forward end, rotating the primary link member about the first pivot 34 on the frame in the direction of the arrow in FIG. 11. At the same time, the support foot 36 is raised, and, due to the secondary connecting link, will pivot inwardly in an anti-clockwise direction about the pivot pin 40. This rotation continues until the bench 14 reaches the upright storage position of FIG. 6, at which point the foot 36 is folded inwardly by secondary link 32 to run alongside the primary link or support tube 30.

The amount that the support foot 36 pivots is controlled by the relative lengths of the two pivotal links 30,32 and the relationship between their attachment points to the frame and to the foot 36. As best illustrated in FIGS. 3 to 5, the links 30,32 are of different lengths, and their attachment points to the frame are offset such that the foot 36 is forced to pivot inwardly and fold up tight against the primary link or support tube 30 when the bench is moved into the storage position.

FIGS. 10 to 12 illustrate sequential positions of the bench as it is folded from a deployed or exercise position into a storage position. In FIG. 10, the bench is shown in an exercise ready, decline press position, although it may be folded up from the flat press position of FIGS. 1 to 3 as well. In the decline press position, cross rod 28 is supported on the lowermost brackets 24 on uprights 18, resulting in the bench inclining downwardly as shown. A barbell 86 on the upright struts does not have to be removed before the bench is stored if the cross rod 28 is in either the lowermost position on brackets 24, or the uppermost position on upper brackets 26, in view of the position of the pivot points spaced in front of the plane of the uprights 18. In the lowest setting, the bar fits into the space between the two seat pads. In the highest setting, the pad will pass under the bar.

FIG. 11 illustrates the bench in an intermediate position during folding, as the linkage 32 starts to fold in support foot 36. FIG. 12 illustrates the stable, automatically locked storage position of the bench. The bench rotates beyond the vertical position so that it is inclined slightly rearwardly when the storage position is reached. The attachment tube 70 on the support foot is designed to be oriented vertically when the bench and foot are both in the folded, storage position of FIG. 12. Thus, any attachments to tube 70 will also be positioned in a substantially vertical, stable orientation when the folded bench is in the storage position, as also illustrated in FIG. 6.

Because the bench is folded past 90° (perpendicular) into the storage position, it will stay in the storage position without requiring any lock pins or other locking devices to hold it in place. The majority of the weight of the bench, i.e. the pads, connecting links, and support foot, is folded past the perpendicular or vertical position, so that the folded bench will be stable and will not tend to fall forwards. At the same time, the four-bar linkage acts as a stop to keep the bench from folding any further back. This provides for optimum weight distribution. Once in the storage position, because of the stable base, the entire bench assembly, with or without attachments, will not easily tip over. The support foot is also automatically held in the folded, stored position of FIGS. 6 and 12 by the secondary links. The bench is virtually locked in the stored position and the support foot must be folded upwardly and outwardly before the bench can be lowered into an exercise ready position. Handles 45 may be used for this purpose.

By pivoting the primary link tube 30 at a precise location spaced above the floor level and in front of the plane defined by the frame uprights 18, the bench can be folded into the storage position without needing to first remove the barbell. When a user is finished with their workout, they simply grab a handle 45, and lift and pivot the front end of the bench as illustrated in FIGS. 6, 11 and 12. This moves the bench apparatus into a very compact, stable storage position where it does not take up any unnecessary floor space. The bench is self-locking in both the storage and exercise ready position.

The bench is readily adjustable between a number of different possible exercise ready positions by adjustment of the height of cross member 28 and the position of carriage 46 on primary link 30. FIGS. 1 to 3 illustrates a flat press position in which the seat pad 52 and back pad 54 are aligned horizontally with carriage 46 at a position adjacent the left hand end of primary link or support tube 30 and the support rod 62 of back pad 54 resting on cross member 28 with the ends of the cross member supported on the second pair of brackets 25 on uprights 18. The angle of the bench can be readily adjusted to a decline press position simply by moving the cross member down to rest on the lowermost brackets 24. The back pad will then be inclined downwardly, along with seat pad 52, to a flat, decline press orientation, as illustrated in FIG. 10.

The bench may be readily moved from the flat press position of FIG. 3 to the incline press position of FIG. 4 simply by moving the cross member 28 to the uppermost pair of brackets 26, and moving carriage 46 along link or tube 30 towards the uprights 18 or rear end of the bench apparatus, until the desired angle of back pad 54 relative to seat pad 52 is reached. At this point, the carriage is locked in position via pop pin 48. This adjustment is made easier by the fact that the support rod 62 on the back pad runs along groove 65 in the wheel 66, which rotates about the cross member 28 to accommodate the adjustment. Thus, no wear is incurred by sliding of the back pad back and forth across cross member 28. The bench is moved from the incline press position of FIG. 4 to the shoulder press position of FIG. 5 simply by unlocking carriage 46, and sliding it further along tube 30 until the back pad reaches the nearly vertical orientation illustrated, at which point the carriage 46 is again locked in position. Thus, the bench is adjustable between a wide variety of different possible exercise ready positions, as well as being readily movable into a storage position when not in use.

In this arrangement, the back pad and seat pad are pivoted to the carriage 46 at two separate locations 60,64. This has the advantage that the pivot attachments can be adjusted and tightened independently. Because of this, the right amount of pressure can be applied to the seat and back pivot connections to provide both smooth pivot motion and reduced play/wobble in the pads. The pivot support rod 62 of the back pad provides several advantages. First, in conjunction with the rotating wheel 66 it engages on cross member 28, it reduces side-to-side wobble of the back pad during use. Secondly, the arrangement provides multiple adjustment positions for performing various exercises, and increases the ease of adjustment when the bench pad carriage is moved. Thirdly, it increases the strength and stability of the back pad in all positions when lifting of heavy weights is involved. The support rod also prevents wear to both the back pad upholstery and the adjustable cross member surface, which is a problem when the back pad slides directly over a cross piece.

FIGS. 13 to 20 illustrate a foldable bench apparatus 90 according to a second embodiment of the invention. This embodiment is similar to the first embodiment, but eliminates the spaced uprights 18. Additionally, unlike the previous embodiment, the seat pad and back pad are not separately pivoted to a moving carriage in this embodiment.

The apparatus 90 basically comprises a bench assembly 92 pivoted to a stationary frame. The stationary frame has a generally upright strut 94, a base support strut 95 extending horizontally away from strut 94 at the lower end of the strut, and a cross bar 96 with feet 98 extending across the end of strut 95 to provide a stable base for the apparatus. The bench assembly is pivotally mounted at the upper end of upright strut 94. The bench assembly 92 comprises a bench support bar or tube 100 on which separate first and second pads 102, 104 are mounted. The bench support tube 100 is pivoted to the upper end of upright strut 94 via pivot pin 105.

Figure 15:
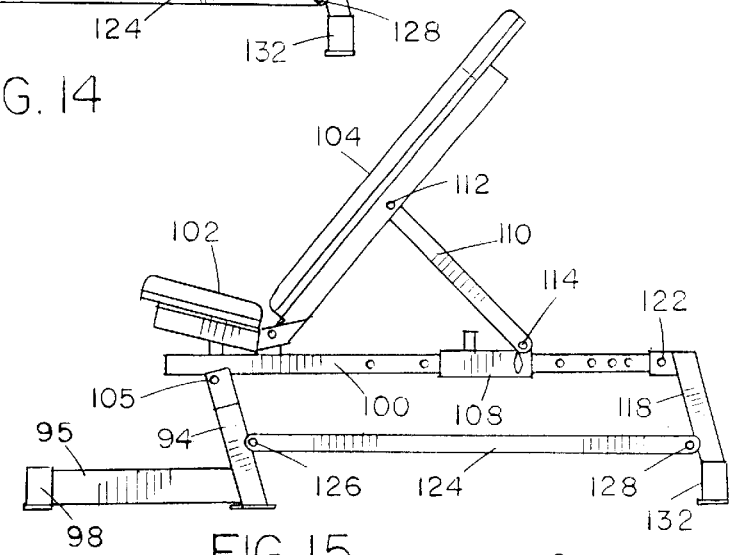
FIG. 15 is a similar view with the back rest raised.

The two pads are each pivotally secured to the bench support tube via pivot 106 at their adjacent inner ends. The second pad 104, which acts as a back pad in some orientations of the bench, is also connected to a carriage 108 which is slidably mounted on support tube 100. The pad 104 is connected to the carriage 108 via pivotal link 110, which is pivoted to the back pad via pivot pin 112 and to the carriage 108 via pivot pin 114, as best illustrated in FIG. 15. The carriage may be releasably locked in any selected position on the support tube 100 via pop lock pin 115 extending into any one of a series of spaced openings 116 in the tube 100. Sliding of the carriage 108 along tube 100 will raise and lower the back pad into any one of a plurality of different orientations relative to seat pad 102.

A support foot 118 is pivotally mounted on the upright strut of the stationary frame via a four bar linkage, as in the previous embodiment, and is located adjacent the forward end 120 of the second pad 104. Support tube 100 of the bench is the primary link of the four bar linkage, and support foot 118 for the bench is pivotally mounted at the forward end of primary link or support tube 100 via pivot 122. A secondary link 124 of the four bar linkage is pivotally secured to upright strut 94 at its rear end via pivot pin 126 spaced below and forwardly from pivot pin 105. The forward end of link 124 is pivotally secured to support foot 118 via pivot pin 128 spaced below pivot pin 122. Secondary link 124 may be provided with oppositely directed handles (not illustrated) at a location adjacent its forward end pivot, as in the previous embodiment, for ease in lifting the bench between the deployed and storage positions. Secondary link 124 comprises a pair of parallel connecting links or bars, as best illustrated in FIG. 13.

Support foot 118 has a base cross bar 130 at its lower end, with feet 132 at opposite ends of cross bar 130 for added stability. As in the previous embodiment, the support foot 118 is designed to be inclined forwardly from the forward ends of support tube 100 and pad 104 in the deployed position of FIGS. 13 to 15. The relationship between the support foot 118 and the primary and secondary connecting links 100, 124 of the four bar linkage is such that the secondary links 124 wedge the support foot against the floor and the end of the primary link tube 100 in the deployed position. The support foot therefore supports the bench in a stable and secure position.

Figure 13:
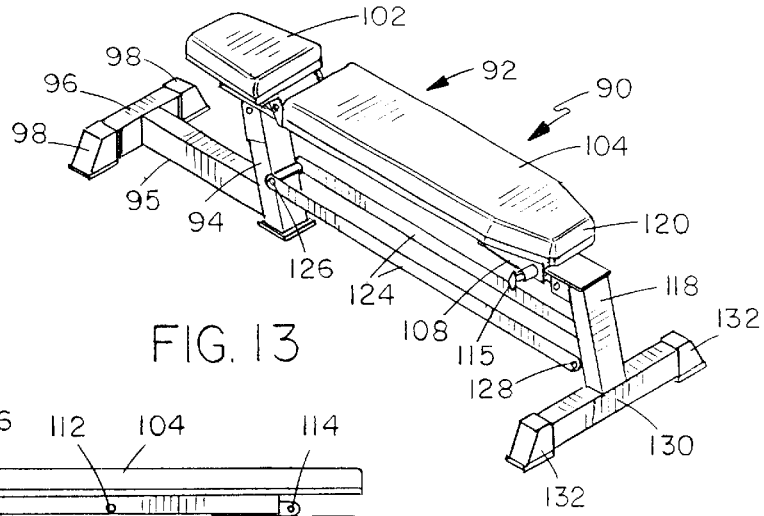
FIG. 13 is a perspective view of a bench unit according to another embodiment of the invention.
Figure 14:
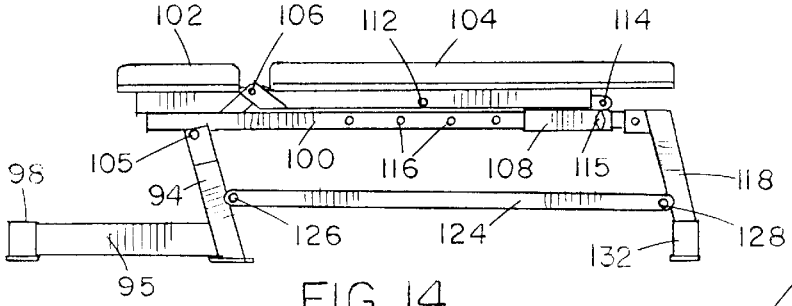
FIG. 14 is a side view of the unit of FIG. 13 with the bench in a horizontal position.

The two pad exercise bench may be readily adjusted between a variety of different, exercise ready positions, as illustrated in FIGS. 13 to 15 and 18 to 20. FIGS. 13 and 14 illustrate a flat press position of the bench, in which the pads 102, 104 are both oriented horizontally and a user can lie flat across the bench to lift weights. The pivot link 110 is folded flat under pad 104 and the carriage 108 is located at the right hand end of the support tube 100 as viewed in FIGS. 13 and 14. If a user wishes to move the bench into an incline press position, the carriage lock pin 115 is released, and the carriage is moved rearwardly along tube 100, simultaneously tilting pivot link 110 upwardly and forcing the second pad 104 to pivot upwardly about pivot pin 106 until it is tilted upwardly relative to the first pad 102. The second pad 104 is locked in position when a desired orientation relative to the first pad 102 is reached. FIG. 15 illustrates one possible incline press position. Further movement of carriage to the left as viewed in FIG. 15 will result in a more upright orientation suitable for shoulder press exercises. In both the incline press and shoulder press positions, pad 104 acts as a back pad while pad 102 acts as a seat pad.

Figure 17:
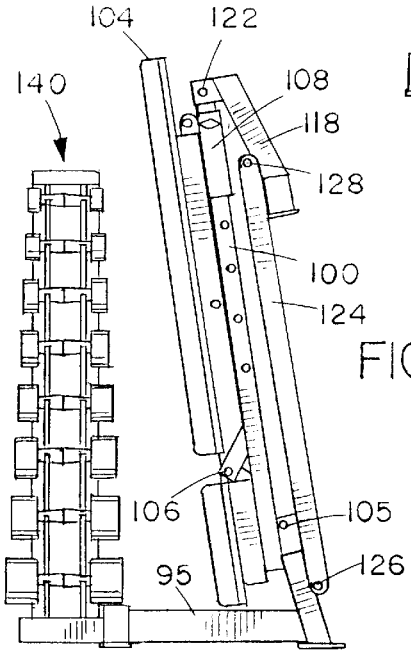
FIG. 17 shows the unit fully folded.
Figure 16:
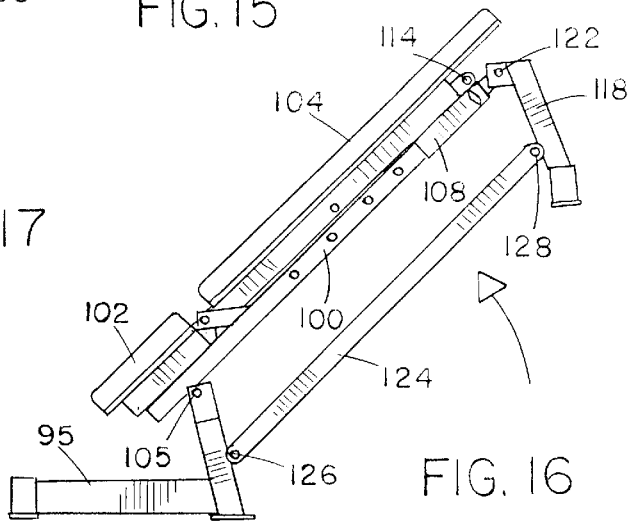
FIG. 16 shows the unit partially folded.

The exercise bench may be readily folded from the deployed, exercise position of FIG. 14 into a generally upright, storage position as illustrated in FIG. 17. The user simply grips either the end of pad 104 or a handle (not illustrated) on link 124, and lifts the entire bench assembly upwardly and rearwardly in the direction of the arrow in FIG. 16. As the bench lifts up, the four bar linkage will pull the support foot 118 inwardly to fold up against the support tube 100. The assembly pivots through an angle of more than 80°, past the vertically upright position, so that it is inclined slightly rearwardly in the storage position of FIG. 17. Because it is tilted rearwardly, and the majority of the weight of the bench and the center of gravity are to the rear, it will not tend to fall back forwardly towards the horizontal position unless positively pulled away from the storage position. At the same time, the four bar linkage locks the bench assembly against tilting any further to the rear, and the solid, stable support base or frame will resist tipping over. Thus, no separate locking device is needed to lock the assembly in the storage position, unlike prior art arrangements. It can be seen that the bench assembly takes up very little floor space when in the storage position.

The bench apparatus 10 may optionally include a vertical dumbbell rack 140 secured to the rear end of the stationary frame in place of cross bar 96, as illustrated in FIG. 17. This provides convenient, compact storage for free weights or dumbbells, while adding to stability and resistance against tipping when the bench is in the upright storage position.

The stored bench cannot be rotated back into an exercise ready position without first pulling the support foot outwardly and upwardly, as in the previous embodiment. The bench can then be rotated downwardly about pivot 105 back into the deployed, exercise ready position of FIG. 14.

Figure 18:
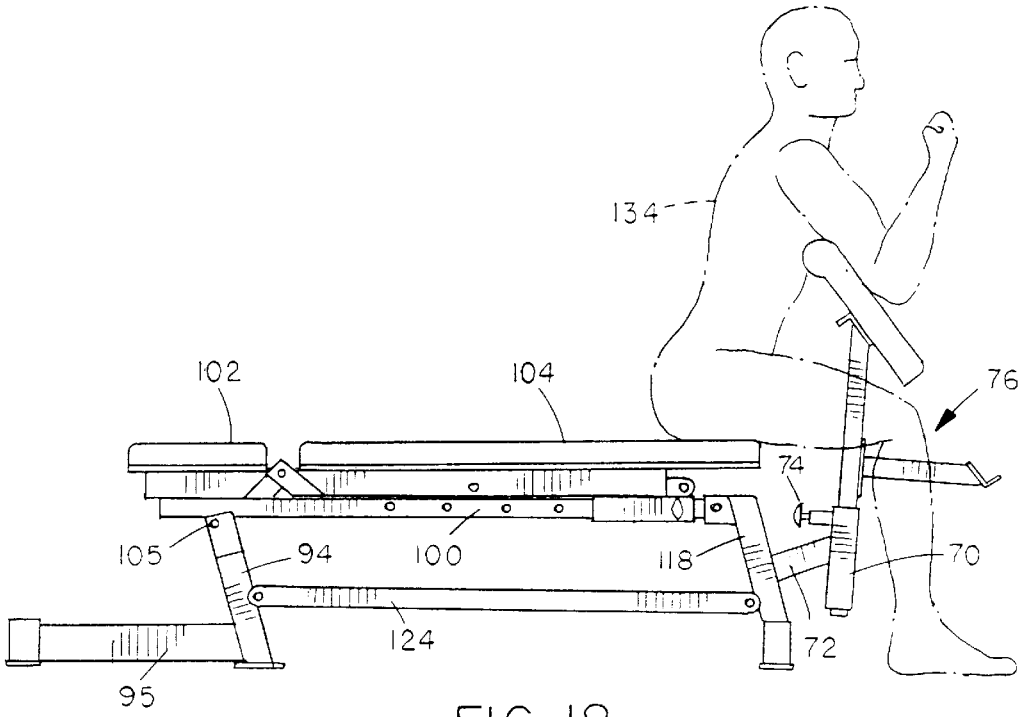
FIG. 18 is a side view similar to FIG. 14 with an attached preacher curl accessory, and showing a user in position.
Figure 19:
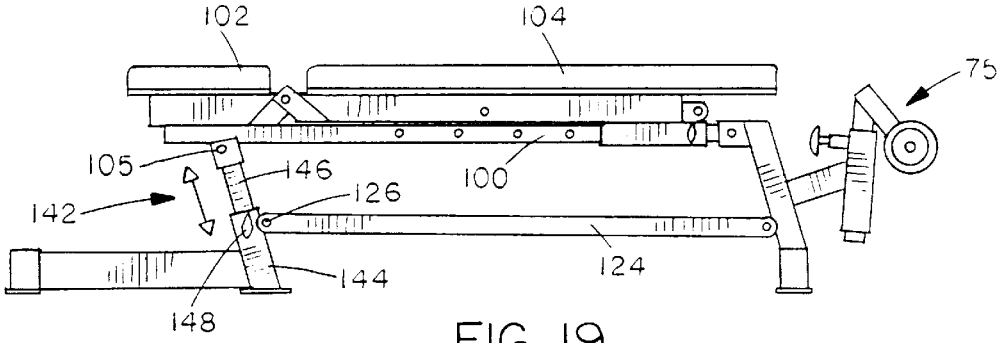
FIG. 19 is a side view similar to FIG. 14, with an additional adjustment for the bench, and with a different accessory attached to the bench support foot.
Figure 20:
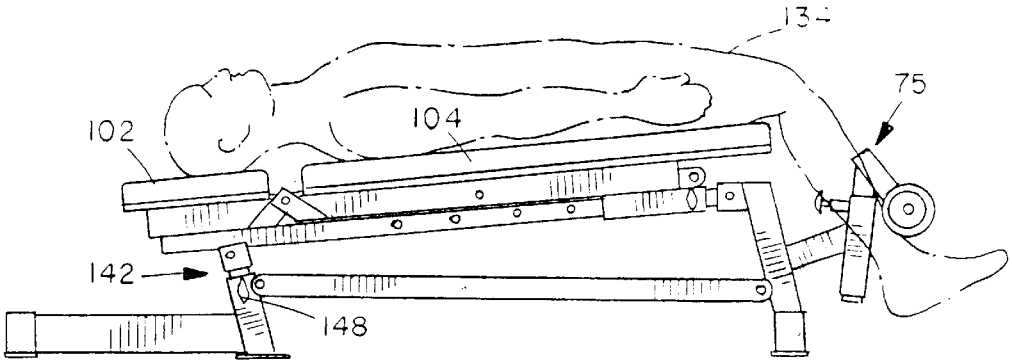
FIG. 20 shows the unit of FIG. 19 with the bench inclined and with a user in position.

As in the previous embodiment, an attachment tube 70 may be attached to the support foot 118 for securing selected accessories to the foot, as illustrated in FIGS. 18 to 20, and like reference numerals have been used for like parts of the attachment as appropriate. Also as in the previous embodiment, the attachment tube 70 is oriented relative to foot 118 so that it will extend vertically in both the deployed and storage positions of foot 118. FIG. 18 illustrates a preacher curl attachment 76 secured in tube 70, with a user 134 seated on pad 104 with their arm resting on attachment 76 to perform preacher curl exercises. FIGS. 19 and 20 illustrate optional attachment and use of adjustable leg rollers 75.

FIGS. 19 and 20 also illustrate another optional modification, in which fixed upright strut 94 of FIGS. 13 to 18 is replaced with adjustable strut 142 which may be adjusted in height to adjust the height of the rear end of the bench. Adjustable strut 142 has a base tube 144 and an upper rod 146 telescopically mounted in tube 144. The bench support tube 100 is pivotally secured to the upper end of rod 146 via pivot 105. A pop pin 148 extending through an opening in tube 144 and any one of a series of aligned openings in rod 146 locks the rod at any desired extension out of tube 144. FIG. 20 illustrates the adjustable strut 142 in its lowermost position, which orients the bench in a decline press position for use by an exerciser reclining on the bench with their head on pad 102. By extending the strut 142 as in FIG. 19, the bench can be positioned in a flat, horizontal orientation for flat press exercises.

Although the bench is formed in two separate parts in each of the above embodiments, it may be alternatively comprise a single pad for supporting the user. Referring to FIGS. 19 and 20, if a single pad on a single support replaced pads 102, 104, the bench could be adjusted past horizontal and the user could perform decline (FIG. 20), flat (FIG. 19) and incline exercises while lying prone on the pad.

In each of the above embodiments, a foldable exercise bench with a pivotally attached support foot can be moved readily between the deployed or exercise-ready position simply by lifting up or lowering the bench with one hand, without having to release any locking pins or devices and subsequently re-insert locking pins after moving the bench to a new position. The support foot is automatically folded up flat against the bench by a four-bar linkage as the bench is lifted into the storage position, and the apparatus is automatically self-locking in each position. Because the bench is rotated rearwardly past the vertical position into the storage position, the weight distribution and center of gravity is such that the bench will stay in the storage position until positively moved out of that position by a user, without any need for additional locking devices. The exercise bench is designed for performing free weight exercises of various types, and can be readily folded up out of the way when not in use, so that it takes up very little floor space. The bench has multiple, easy to perform adjustments providing a plurality of different exercise positions for performing many different types of free weight exercises.

The bench can fold and unfold with very little effort. The support foot automatically folds in as the bench is folded, and the bench is self-locking in both the exercise ready and storage position without the use of locking pins. This is both safer and more convenient than previous systems requiring locking pins which could fall out, be misplaced, or, if used improperly, potentially result in injury.

Although a preferred embodiment of the invention has been described above by way of example only, it will be understood by those skilled in the field that modifications may be made to the disclosed embodiment without departing from the scope of the invention, which is defined by the appended claims.

I claim:

1. A foldable exercise bench apparatus, comprising a stationary frame;

an exercise bench pivotally mounted on the frame for movement between a retracted, generally upright storage position and at least one deployed position for supporting a person during exercise, the bench having opposite first and second ends;

a support foot adjacent the first end of the bench having an upper end pivotally mounted relative to the bench for rotation between a first, storage position extending generally alongside the bench when the bench is in the upright, storage position, and a second, support position in which the support foot extends at an angle to the bench and engages the floor to support the bench in the deployed position; and a pivotal linkage between the support foot and frame for automatically pivoting the support foot from the second position to the first, storage position when the bench is moved into the upright, storage position, wherein the pivotal linkage comprises a four-bar linkage having a first bar pivoted at one end to the frame and at the other end to the upper end of the support foot, and a second bar pivoted to the frame at a location spaced from the first bar, and pivoted to the support foot at a location spaced from the upper end;

the bench and support foot each being freely movable from the deployed and storage positions to the storage and first positions, respectively, by lifting the bench, the bench support foot and pivotal linkage all being oriented at a non-vertical, rearwardly inclined angle when said exercise bench is in said storage position, and said support foot having a free end which rests on the floor below the pivot connection between said second bar and said foot support.

2. The apparatus as claimed in claim 1, wherein the four-bar linkage comprises means for automatically locking the support foot in both the storage position and the deployed position of the bench.

3. The apparatus as claimed in claim 2, wherein the bench is supported on top of the first bar, said bench comprising at least one pad for supporting a user.

4. The apparatus as claimed in claim 3, including a carriage slidably mounted on the first bar and movable into a plurality of different positions on the bar, the pad being pivotally linked to the carriage, whereby adjustment of the carriage position varies the orientation of the pad.

5. The apparatus as claimed in claim 2, wherein the bench is formed in two separate parts, comprising a back pad and a seat pad, and at least the back pad is pivotally mounted on the first, support bar for movement between a plurality of different orientations relative to the seat pad.

6. The apparatus as claimed in claim 5, including a carriage slidably mounted on the first bar and movable into a plurality of different positions along the bar, and a locking device for releasably locking the carriage in a selected position on the bar, at least the back pad being pivotally linked to the carriage, whereby adjustment of the carriage position varies the orientation of the bench.

7. The apparatus as claimed in claim 6, wherein both the back pad and seat pad are mounted on the carriage.

8. The apparatus as claimed in claim 7, including two separate pivots on the carriage separately pivoting the back pad and the seat pad to the carriage.

9. The apparatus as claimed in claim 5, wherein the stationary frame comprises a pair of spaced uprights and a cross-member adjustably mounted to extend between the uprights at any one of a series of at least three different heights corresponding to different back pad positions, and the back pad lies against the cross-member in each of the different positions to provide the desired back pad orientation relative to the seat pad.

10. The apparatus as claimed in claim 9, including a support wheel rotatably mounted at the center of the cross member, and the back rest having a pivot support which slidably engages the wheel, whereby the pivot support slides freely along the wheel as the back pad is adjusted upwardly and downwardly.

11. The apparatus as claimed in claim 10, wherein the support wheel and pivot support have mating interengageable formations for providing positive sliding engagement between said support wheel and pivot support, one of said formations comprising a concave groove and the other formation having a convex surface for slidably engaging the groove.

12. The apparatus as claimed in claim 11, wherein said concave groove is provided on said wheel, and said pivot support comprises a rod slidably engaging said groove.

13. The apparatus as claimed in claim 1, wherein the bench rotates through an angle of greater than 90° when moving between the deployed position and the storage position.

14. The apparatus as claimed in claim 1, wherein the support foot rotates through an angle of greater than 80° in moving between the second, support position and the first, storage position.

15. The apparatus as claimed in claim 1, wherein the stationary frame has a forward end and a rear end, the bench extending forwardly from the frame in the deployed position, and being inclined rearwardly beyond the vertically upright position in the storage position.

16. The apparatus as claimed in claim 1, wherein the support foot has an attachment device for selective mounting of an accessory on the support foot.

17. The apparatus as claimed in claim 16, including a plurality of accessories for selective mounting on said attachment device, the accessories including at least an adjustable leg roller device, a preacher curl device, and a leg extension/curl device.

18. The apparatus as claimed in claim 16, wherein the attachment device comprises an attachment tube secured to the foot at a predetermined orientation such that the tube extends substantially vertically when the bench is in the support and storage positions.

19. The apparatus as claimed in claim 1, wherein the support foot projects forwardly at an obtuse angle to the bench when engaging the floor in the first position.

20. The apparatus as claimed in claim 1, wherein the stationary frame includes at least one upright member having a front side and a rear side, the bench extending forwardly from the front side of the upright member, and at least one horizontal, ground engaging member secured to the lower end of the upright member and extending a predetermined distance rearwardly from the upright member.

21. The apparatus as claimed in claim 1, wherein the support frame comprises two spaced upright members.

22. The apparatus as claimed in claim 21, including a fixed cross bar linking the upright members, the bench being pivotally mounted on the fixed cross bar.

23. The apparatus as claimed in claim 21, wherein each upright member is adjustable in height and the upright members each have a bracket for supporting a respective end of a barbell at their upper ends.

24. The apparatus as claimed in claim 1, including a vertical dumbbell rack attached to the stationary frame at a location spaced from the exercise bench.

25. A foldable exercise bench apparatus, comprising a stationary frame having a forward end and a rear end;

an exercise bench pivotally mounted on the frame for movement between a retracted, generally upright storage position and at least one deployed position for supporting a person during exercise, the bench having opposite forward and rear ends;

a support foot adjacent the forward end of the bench having an upper end pivotally mounted relative to the bench for rotation between a first, storage position extending generally alongside the bench when the bench is in the upright, storage position, and a second, support position in which the support foot extends at an angle to the bench and engages the floor to support the bench in the deployed position; and a pivotal linkage between the support foot and frame for automatically pivoting the support foot from the second position to the first, storage position when the bench is moved into the upright, storage position;

the pivotal linkage comprising means for automatically locking the bench in the storage and deployed positions; and the bench, support foot and pivotal linkage all being oriented at a non-vertical, rearwardly inclined angle when said exercise bench is in said storage position.

* * * * *